US012735151B1

(12) United States Patent
Hellweg

(10) Patent No.: US 12,735,151 B1
(45) Date of Patent: Sep. 15, 2026

(54) SPORTS BOARD STORAGE DEVICE

(71) Applicant: Eric Hellweg, Perris, CA (US)

(72) Inventor: Eric Hellweg, Perris, CA (US)

( * ) Notice: Subject to any disclaimer, the term of this patent is extended or adjusted under 35 U.S.C. 154(b) by 0 days.

(21) Appl. No.: 17/352,120

(22) Filed: Jun. 18, 2021

Related U.S. Application Data

(63) Continuation-in-part of application No. 17/134,424, filed on Dec. 27, 2020, now Pat. No. 11,447,211, which is a continuation of application No. 16/833,627, filed on Mar. 29, 2020, now Pat. No. 10,875,610, and a continuation of application No. 16/724,260, filed on Dec. 21, 2019, now Pat. No. 10,870,468.

(60) Provisional application No. 63/041,723, filed on Jun. 19, 2020, provisional application No. 62/788,328, filed on Jan. 4, 2019.

(51) Int. Cl.
*B63B 32/83* (2020.01)
*B63B 32/40* (2020.01)

(52) U.S. Cl.
CPC ..... *B63B 32/83* (2020.02); *B63B 32/40* (2020.02)

(58) Field of Classification Search
CPC ..... B63B 32/83; B63B 32/80; B63B 32/70; B60R 9/08; B60R 9/12; B60R 9/048; B25B 5/14; A63C 11/028; A47F 7/0035; A47F 5/2013; A47B 47/005; A47B 7/0058
USPC ..... 224/406
See application file for complete search history.

(56) References Cited

U.S. PATENT DOCUMENTS 4,234,112 A * 11/1980 Gallant ..... B60R 9/12 224/570
4,863,082 A * 9/1989 Evans ..... B63B 32/83 224/406
5,657,913 A * 8/1997 Cucheran ..... B60R 9/12 224/558
5,788,133 A * 8/1998 Mareno ..... B63B 23/62 224/406
6,390,309 B1 * 5/2002 Tucker ..... B63B 32/83 D6/552
6,561,396 B2 * 5/2003 Ketterhagen ..... B60R 9/042 414/547
7,451,968 B2 * 11/2008 Geldert ..... B60R 9/08 269/261
8,123,051 B2 * 2/2012 Johnson ..... A47F 7/0021 211/87.01
9,045,090 B2 * 6/2015 Wilhelm ..... B63B 32/83
9,308,974 B1 * 4/2016 Randall ..... B63B 29/00
9,346,409 B2 * 5/2016 Pfaeffli ..... B60R 9/045
2002/0162868 A1 * 11/2002 DeCosta ..... B60R 9/058 224/324
2007/0057000 A1 * 3/2007 Webster ..... B60R 9/06 224/531
2007/0062992 A1 * 3/2007 Hepworth ..... B60R 9/08 224/558

(Continued)

OTHER PUBLICATIONS https://www.skyski.com/product-p/64-0125.htm, web page showing picture of board rack on sale since 2008.

*Primary Examiner* — Adam J Waggenspack

(57) ABSTRACT

A storage device is configured to hold one or more sports boards. The storage device has a mechanism that transitions the device between a clamped and unclamped state upon actuation of an actuation device. A user can actuate an actuator from a first position towards the device to a second position to transition the device from the clamped to the unclamped state.

7 Claims, 19 Drawing Sheets

(56) References Cited

U.S. PATENT DOCUMENTS

| | | | | |
|---|---|---|---|---|
| 2007/0209567 | A1* | 9/2007 | Fee | B63B 17/00 114/1 |
| 2013/0193176 | A1* | 8/2013 | Khoo | B60R 9/08 224/324 |
| 2017/0362768 | A1* | 12/2017 | Molina Sanchez | B60R 9/058 |
| 2018/0022284 | A1* | 1/2018 | Bessette | B60R 9/08 224/315 |

* cited by examiner

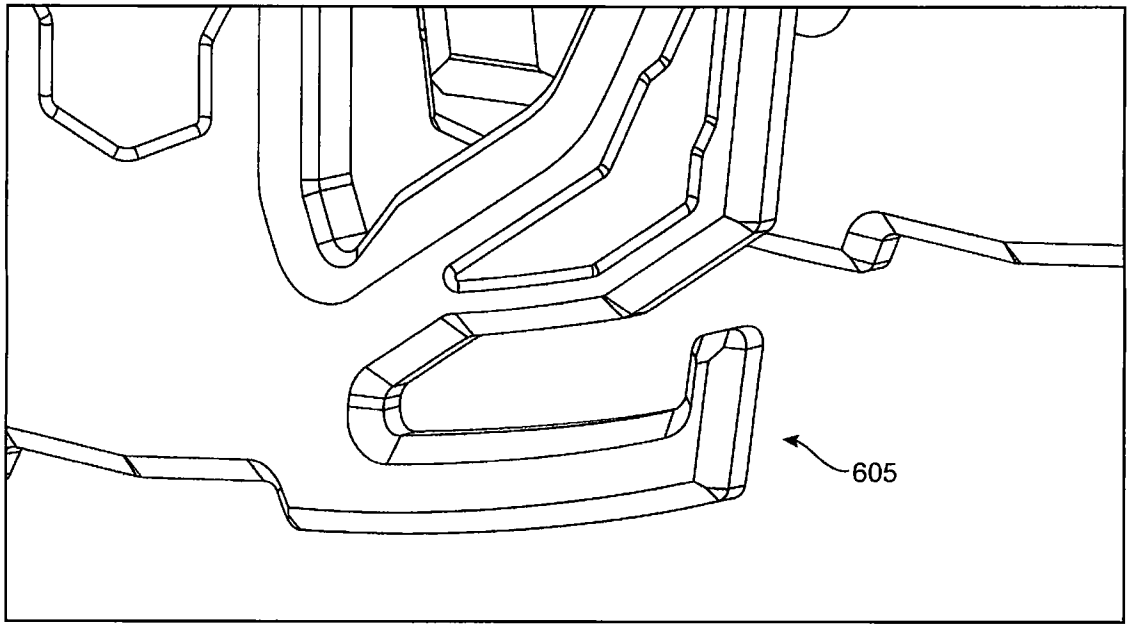
FIG. 6
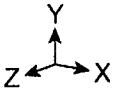

SPORTS BOARD STORAGE DEVICE

REFERENCE TO PRIORITY DOCUMENT

This application: (1) claims priority to U.S. Provisional Patent Application Ser. No. 63/041,723 entitled "Sports Board Storage Device" and filed on Jun. 19, 2020; (2) is a continuation-in-part of U.S. patent application Ser. No. 17/134,424 entitled "SPORTS BOARD STORAGE DEVICE" and filed on Dec. 27, 2020, which is a continuation of U.S. patent application Ser. No. 16/833,627 entitled "SPORTS BOARD STORAGE DEVICE" (now U.S. Pat. No. 10,875,610) and filed on Mar. 29, 2020, which is a continuation of U.S. patent application Ser. No. 16/724,260 entitled "SPORTS BOARD STORAGE DEVICE" (now U.S. Pat. No. 10,870,468) and filed on Dec. 21, 2019, which claims priority to U.S. Provisional Patent Application Ser. No. 62/788,328 entitled "Sports Board Storage Device" and filed on Jan. 4, 2019. The disclosures of the patent applications are incorporated herein by reference in their entirety.

BACKGROUND

Wakeboarding is a sport that is growing in popularity. In the sport of wakeboarding, a boat tows a person by a rope in a similar manner similar waterskiing. However, a typical wakeboard is wider and shorter than a waterski. Consequently, a wakeboard may use up a different quantity of space in a boat relative to the space used by a waterski. In view of this, with wakeboards there is a need for proper storage of one or more wakeboards on a boat in a manner that does not inhibit space within the passenger compartment of a boat.

Consequently, wakeboards are often stored in an onboard board storage device that clamps one or more wakeboards in a fixed position on the boat. Current storage devices for boards such as wakeboards have certain drawbacks and there is a need for improved storage devices for wakeboards and other planar devices.

SUMMARY

Disclosed herein is a storage device that is configured to hold or store one or more planar devices, such as wakeboards.

The details of one or more variations of the subject matter described herein are set forth in the accompanying drawings and the description below. Other features and advantages of the subject matter described herein will be apparent from the description and drawings, and from the claims.

BRIEF DESCRIPTION OF THE DRAWINGS

FIG. 6 shows an enlarged view of a hook of the board storage device.

DETAILED DESCRIPTION

Before the present subject matter is further described, it is to be understood that this subject matter described herein is not limited to particular embodiments described, as such may of course vary. It is also to be understood that the terminology used herein is for the purpose of describing a particular embodiment or embodiments only and is not intended to be limiting. Unless defined otherwise, all technical terms used herein have the same meaning as commonly understood by one skilled in the art to which this subject matter belongs.

Disclosed herein is a storage device that is configured to hold or store one or more planar devices, such as wakeboard(s). Although the device is described herein in the context of storing wakeboards, it should be appreciated that the device can be used to store any of a variety of devices and in particular planar devices such as wakeboards or other sports boards. The storage device has a clamp mechanism that can be actuated to exert a clamping force onto one or more wakeboards that are positioned on or in the storage device to retain the one or more wakeboards on the storage device, as described more fully below. The clamp mechanism can be locked into a clamped (or clamping) state such that the clamped wakeboard(s) cannot be removed from the board storage device when the clamp mechanism is locked.

In an embodiment, a user pushes or otherwise moves (such as downwardly) a clamp arm of the clamp mechanism from a first (or unclamped or released) position to a second (or clamped or clamping) position to transition the clamp mechanism from an unclamped state to a clamped state. An internal lock mechanism is configured to automatically place the boards in a clamped, compressed state within the board storage device when the clamp arm is pushed or otherwise moved toward the second position. A lock device, such as a padlock, can be coupled to the clamp arm to constrain or lock the clamp arm in the second position and thereby lock the clamped wakeboards in place within the board storage device.

The board storage device also includes one or more hooks that are configured to hang or store an item, such as a life jacket. In addition, the board storage device includes one or more flag holders.

Figure 1:
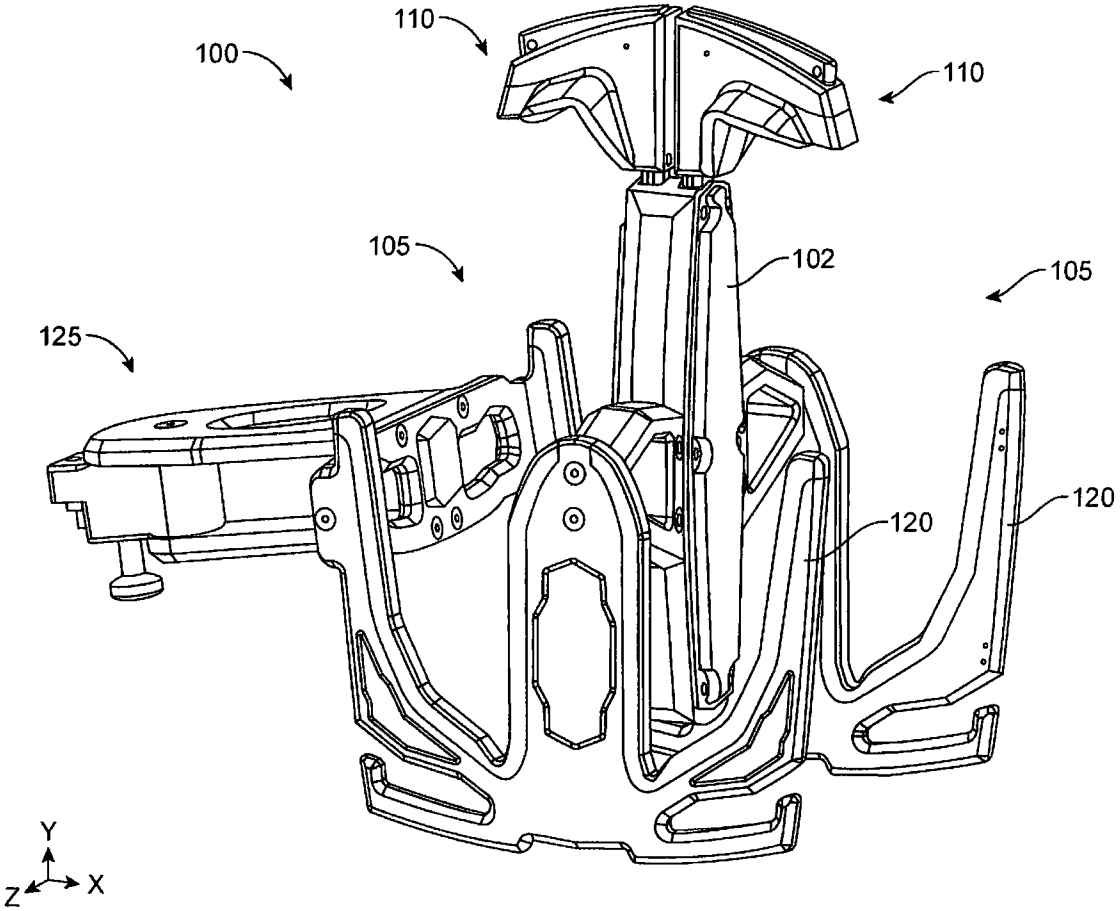
FIG. 1 shows a perspective view of a board storage device with a clamp arm in a closed or retracted position.
Figure 2:
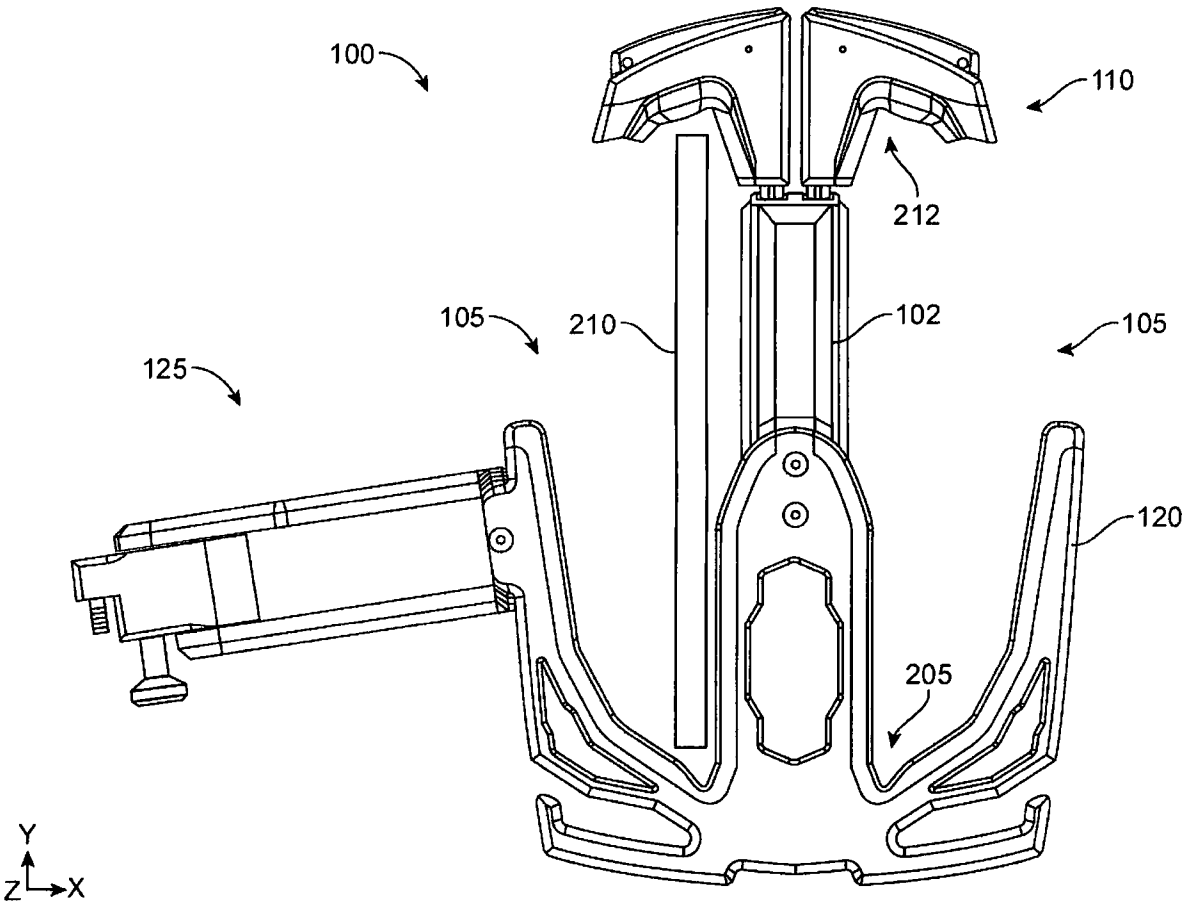
FIG. 2 shows a side view of the board storage device.
Figure 3:
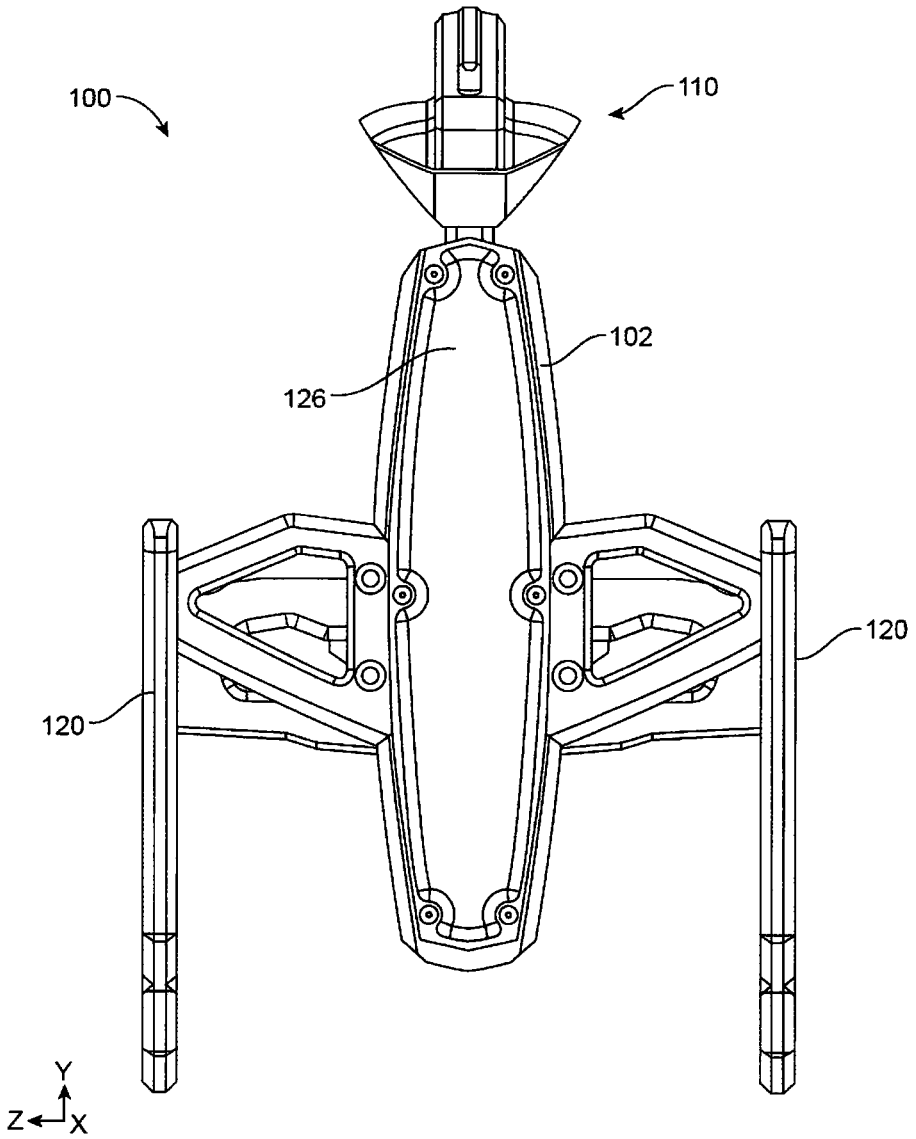
FIG. 3 shows a front view of the board storage device.

FIG. 1 shows a perspective views of an example board storage device 100 (also referred to as "storage device 100 or device 100".) FIG. 2 shows a side view of the board storage device 100. FIG. 3 shows a front view of the example board storage device 100. Each of the x-y-z axes in FIG. 1 can correspond to any of a horizontal or vertical axes. For example, the Y-axis can correspond to a vertical axis in one embodiment or can correspond to a horizontal axis in another embodiment while the device is in actual use.

The board storage device 100 may be mounted on a structure such as on a portion of a watercraft for storing one or more wakeboards on the watercraft. For example, the device may be mounted using clamps, bolts, or other attachment mechanism such as the attachment mechanism 125. The device may be mounted on any portion of the watercraft, such as on a sidewall of a ski boat or any boat that can be used for recreation.

The storage device 100 can be a body that includes a central structure, such as a pillar or post 102, from which one or more arms 120 extend to define rack assemblies 105 that are each configured to store one or more boards. In this regard, each rack assembly 105 (sometimes referred to as a "rack") defines one or more receivers, openings or seats wherein each seat is sized and shaped to receive at least one board therein. One or more bridge structures extend outwardly from the post 102 to connect to a second and third structure (such as post members positioned in parallel relationship with the post 102) from which the arms 120 extend. In another embodiment, the device 100 only includes a single rack assembly or more than two rack assemblies. In FIG. 2, a wakeboard 210 is schematically represented in position within one of the rack assemblies 105 of the board storage device 100. A wakeboard 210 can also be positioned in the other rack assembly 105. It should be appreciated that the wakeboard is a flat or curved planar member that extends outward from the plane of FIG. 2. It should be appreciated that a wakeboard 210 (or other type of board) can have a concave or curved outer surface. In other embodiments, the outer surfaces are flat.

With reference still to FIGS. 1 and 2, each of the two rack assemblies 105 is defined by the central post 102 and the arms 120 that extend outwardly from the post 102. In the embodiment of FIGS. 1-3, the arms 120 extend outwardly in opposite directions relative to the post 102. Each of the arms 120 forms a bottom seat 205 on which a bottom (with respect to FIG. 2) edge of the board 210 can sit or abut. Given that there are two arms 120 in the embodiment of FIG. 2, the bottom seats 205 form second and third seats 205 (with an upper seat 212 forming a first seat 212 as described below.) The shape of each arm 120 can vary and is not limited to the shape shown in the figures. In the illustrated embodiment, each arm 120 extends outwardly from a post member (such as a vertical post in the embodiment of FIGS. 1 and 2). The arm extends transversely outward to form a vertical section that extends upwardly from a base of the arm 120 attached to the post. In this manner, the arm 120 forms a seat 205 as described below. The seat is located at a juncture between the base of the arm 120 and the post from which it extends. The second and third seats can be at positions opposed to the first seat such that the first, second, and third seats collectively form a triangular shape when connected by a line.

For each rack assembly 105, an upper clamp member 110 forms the upper (or first) seat 212 that is sized, positioned, and shaped to contact a top edge of the board 210. The upper clamp member 110 is mounted on an upper end of a clamp arm 405 (FIG. 4) that is slidably and telescopically positioned within the central post 102. Thus, the clamp arm 405 and the attached upper clamp member 110 can slide relative to the post, such as along an axis defined by the post 102. For example, the axis can be co-axial with the post 102.

The clamp arm 405 can be a tubular or cylindrical structure for example. The upper seat 212 can be coated with or formed by a pliable, malleable or soft material. In an implementation, the upper clamp member 110 can be configured to rotate between first and second positions. The upper clamp members rotate about an axis (which can be the axis defined by the post 102) defined by the respective arm 405 to which it is attached. This permits the upper clamp members to rotate out of position thereby permitting easier insertion or removal of the boards from the assembly. The upper clamp arm 405 can be fixedly attached to the arm 405 such that it collectively rotates with the attached arm 405. Or, in an alternate embodiment, the upper clamp member rotates relative to the respective arm 405 about an axis defined by the arm 405.

The upper seat 212 (which isn't necessarily an "upper" seat in the horizontal embodiment described below") can be entirely or partially manufactured of a malleable deformable material that is configured to deform when the board is clamped within the device. The deformation of the material creates or otherwise facilitates a force relative to the board that positions the board in tension or compression and thereby increase the likelihood that the board will remain in place when it is clamped by the upper clamp 405.

When the board is positioned within a respective rack assembly 105 of the board storage device, the board has three points of contact with the respective rack assembly of the board storage device including (1) a point of contact at the upper, or first, seat 212; and (2) a separate point of contact at each the two bottom, or second and third, seats 205 of the rack assembly (for a total of two points of contact at the bottom of the board). The three points of contact enable a tight fit between the board and the rack assembly, which is increased by the deformation of the material of the upper seats and bottom seats (which can also be at least partially manufactured of a deformable or resilient material) to place the board's in tension or compression during clamping.

Figure 15:
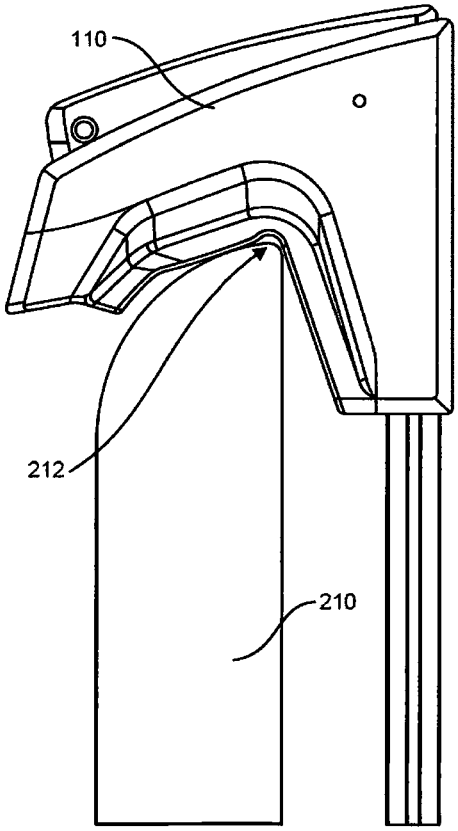
FIGS. 15 and 16 show side views of a wakeboard and an upper clamp member.
Figure 16:
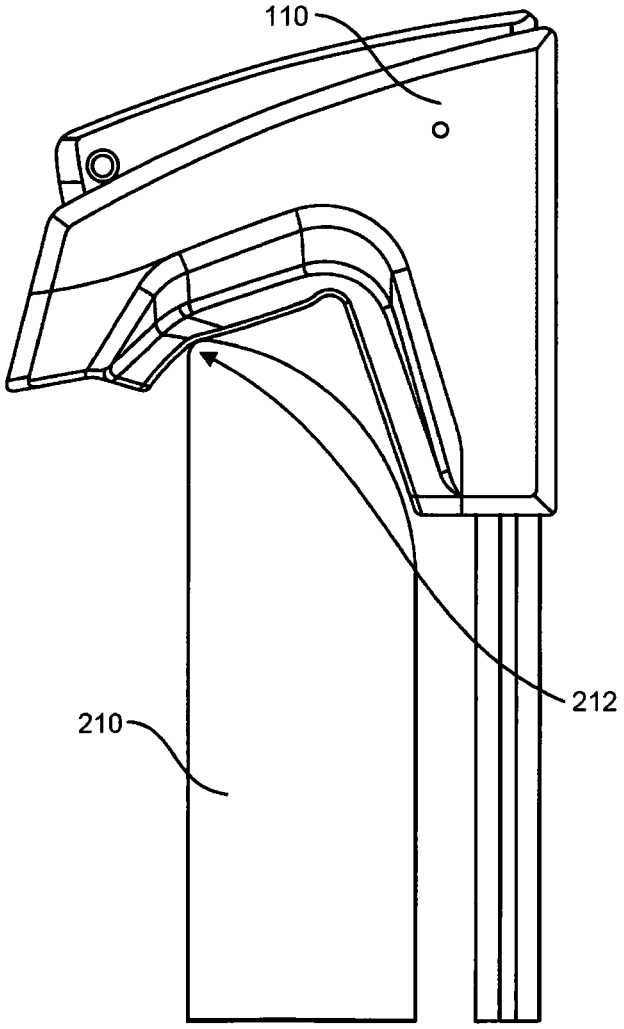

FIGS. 15 and 16 show side views of a wakeboard 210 having at least one outer, curved (such as concave or convex) surface positioned in engagement with the upper clamp member 110. The upper clamp member 110 can have a hook shape and thus may also be referred to as a retaining hook. The upper seat 212 can define one or more particular points of contact where the wakeboard 210 engages the upper seat 212. The upper seat 212 defines an outer surface that contacts the wakeboard 210 when it is mounted in the rack. The outer surface of the upper seat 212 can be smooth and continuous at least along a portion thereof and may also have one or more irregularities, notches, opens, holes, cavities, or other structures that are configured to facilitate engagement between the wakeboard and the upper seat. For example, the structure (such as the notch) can be particularly sized and shaped to receive an edge of the wakeboard, a concave or convex portion of the wakeboard, or any other defined portion of the wakeboard. In FIGS. 15 and 16, the wakeboard is shown in cross-section such that a planar or curviplanar surface of the wakeboard extends normal and outward to a plane of the figures.

When the wakeboard 210 is inserted into the rack and positioned in engagement, such as direct contact, with the upper seat 212, the wakeboard 210 can be inserted with the curved outer surface of the wakeboard facing either of one of two directions, such as directions that are 180 degrees from each other. The concave or curved outer surface of the board 210 can facilitate, govern, or dictate where on the upper seat 212 the wakeboard 210 rests against. In this regard, the upper seat 212 can have one or more notches, cavities, reliefs, or other engagement structures (as described above) that are configured to facilitate engagement between a curved outer surface of the wakeboard 210 and the upper seat 212. The upper seat 212 can have any number of such engagement structures in which a curved outer surface or pointed surface of the board is configured to fit in a snug or complementary manner to facilitate restrained or fixed engagement between the board and the upper seat.

As mentioned, the clamp arm 405 (and the attached upper clamp member 110) can move (such as in a sliding fashion)

between a first, unclamped position and a second, clamped position. In an example, the clamp arm, when in the second, clamped position (such as shown in FIGS. 1-3), the clamp arm 405 is retracted into the central post 102 such that the upper clamp member 110 is closer to the bottom seat 205 (relative to the first position.) In this manner, the upper clamp member 110 can place the wakeboard in compression (between the upper clamp member 110 and bottom seat 205) to retain the wakeboard in place. The central post 102 includes an internal lock mechanism that automatically keeps and locks the clamp arm (and attached upper clamp member 110) in the first position when the upper clamp member 110 is moved toward the bottom seat 205 by a user. An exemplary and non-limiting internal lock mechanism is described in more detail below with reference to FIGS. 7-12.

Figure 4:
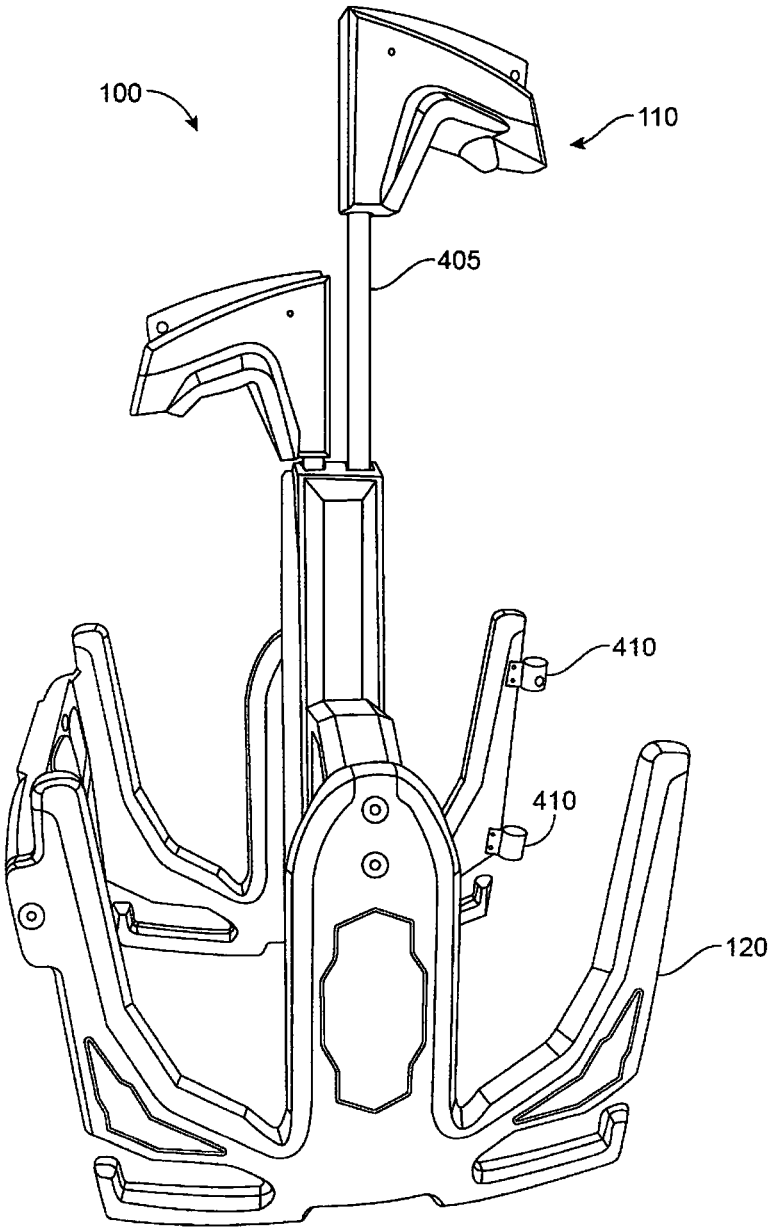
FIG. 4 shows a perspective view of the board storage device with a clamp arm in an open or extended position.

The clamp arm 405 can be released from the second, clamped position by actuating an actuator, such as a levered actuator 505, as described below. When actuated, the actuator releases the clamp arm from the second, clamped position such that a user can slidably extend the clamp arm outwardly (e.g., upwardly in the embodiment if FIG. 3 and horizontally in the embodiment of FIG. 13) from the central post 102. In this manner, the upper clamp member 110 slides away from the bottom seat 205 so as to provide sufficient space so that the wakeboard can be removed from the board storage device 100. As mentioned, in an example embodiment the upper clamp member can rotate to provide additional space for the board to be inserted into the board storage device. FIG. 4 shows the board storage device 100 with the clamp arm 405 in the second, unclamped state.

It should be appreciated that each rack assembly can have any quantity of arms 120 to form a desired quantity of seats. A wakeboard 210 (or other board) may be sized with a length so that the board extends between the two seats 210 of each rack assembly.

Each seat 205 includes a base surface (the upper surface of each seat 205) that forms a surface upon which a board can be positioned or rested upon. When positioned in the seat 205, a bottom edge of the board rests on the seat 205. The seat 205 can be formed of or coated with a material that is soft or is otherwise configured to present a soft or malleable surface for the board. The malleable portion can be integrally or monolithically formed as part of the seat 205 or, alternately, the malleable portion can be a component that is removably or fixedly attached to the seat 205. The malleable portion can be, for example, an insert that inserts into the seat 205. In a non-limiting embodiment, the malleable portion is at least partially made of rubber. The malleable portion can be sized and shaped to facilitate a snug or tight receipt of a portion of the board (such as an edge portion). For example, the malleable portion can have a U or hook shape to receive the portion of the board.

Figure 5:
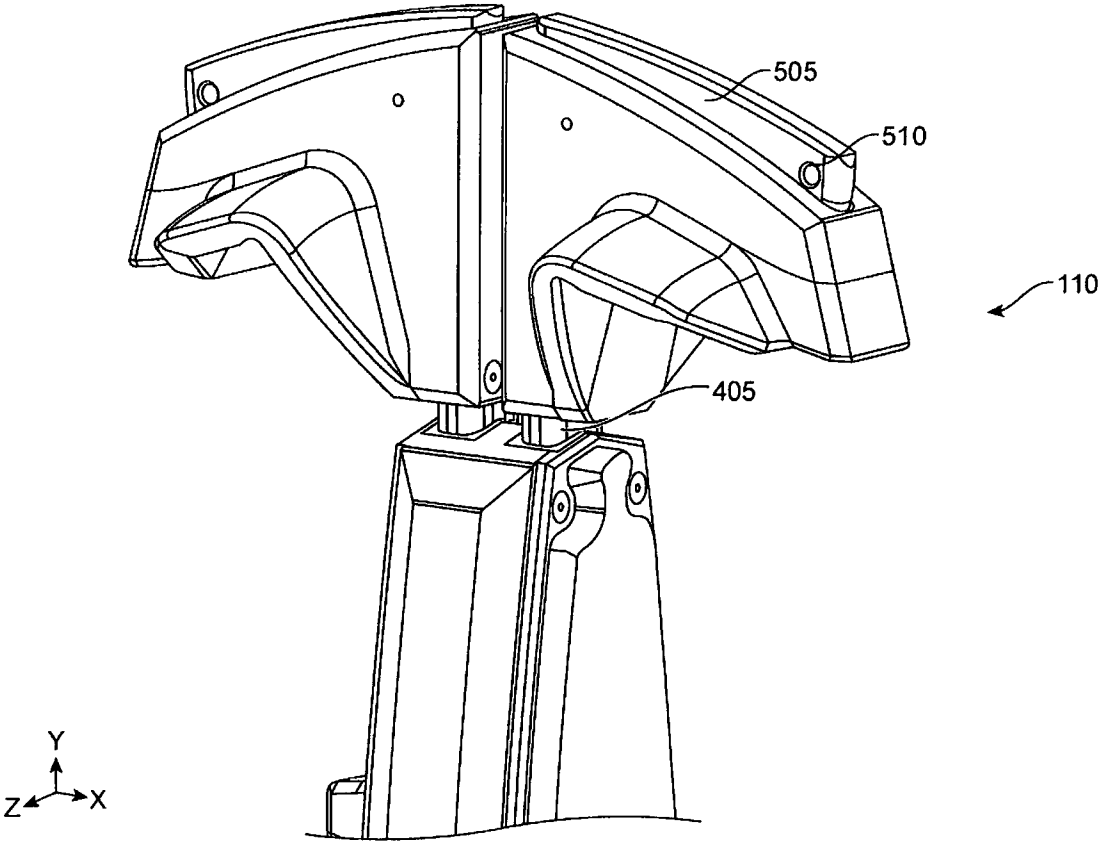
FIG. 5 shows an enlarged view of an upper clamp member of the board storage device.

FIG. 5 shows an enlarged view of the upper clamp member 110, which is mounted on the clamp arm 405. An actuator 505, such as a levered member 505, is movably coupled to the upper clamp member 110 as well as to an internal lock mechanism. The member 505 can be actuated, such as by pushing the member 505 toward the upper surface of the clamp member 110. This causes the member 505 to rotate or pivot about an axis and actuate an internal mechanism that releases the arm from the second, clamped state and permits the upper clamp member 110 to be moved toward the first, unclamped state. In this manner, a user can actuate the member 505 to raise the upper clamp member and release the boards from the rack assembly.

With reference still to FIG. 5, the system includes a securing mechanism configured to secure the actuator from being actuated. For example, an opening or bore 510 is positioned in the member 505. A lock, such as a padlock (or other device such as a pin), can be inserted through the bore 510 to prevent the member 505 from being actuated and thereby lock the upper clamp member 110 in the second, clamped state. That is, the law prevents the actuator from being actuated and thereby prevents the clamp member for moving from the second position to the first position.

With reference now to FIG. 6, a hook 605 is located on the storage device 100 such as on a bottom region of the storage device 100. The hook 605 is sized and shaped to serve as a hook from which items, such as life preservers or articles of clothing, can be hung.

With reference again to FIG. 4, the device includes flag couplers 410, such as cylindrical members 410 each with cylindrical openings, through which a flag can be mounted. Each cylindrical member 410 defines an internal lumen through which the post on which a flag is mounted can be inserted.

Figure 7:
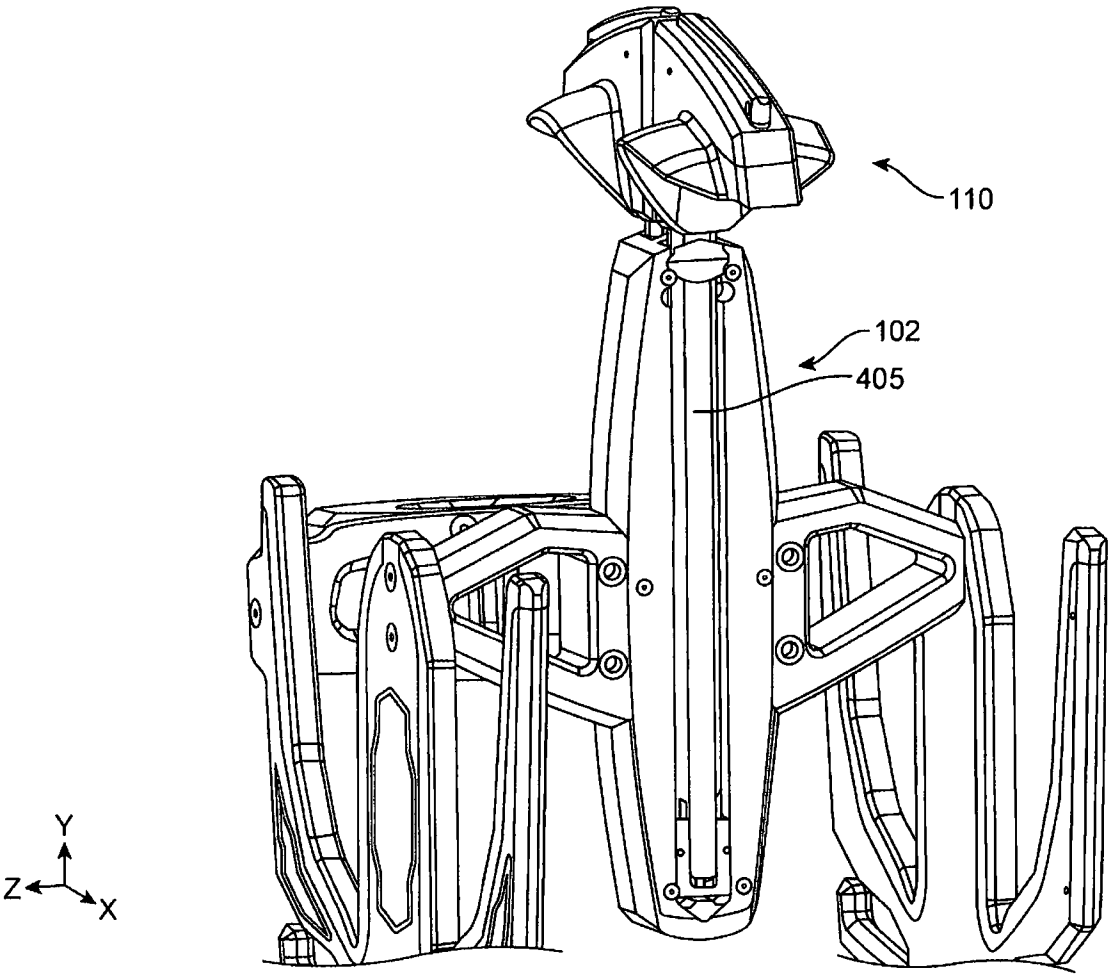
FIGS. 7-12 show various views of an internal lock mechanism of the board storage device.
Figure 8:
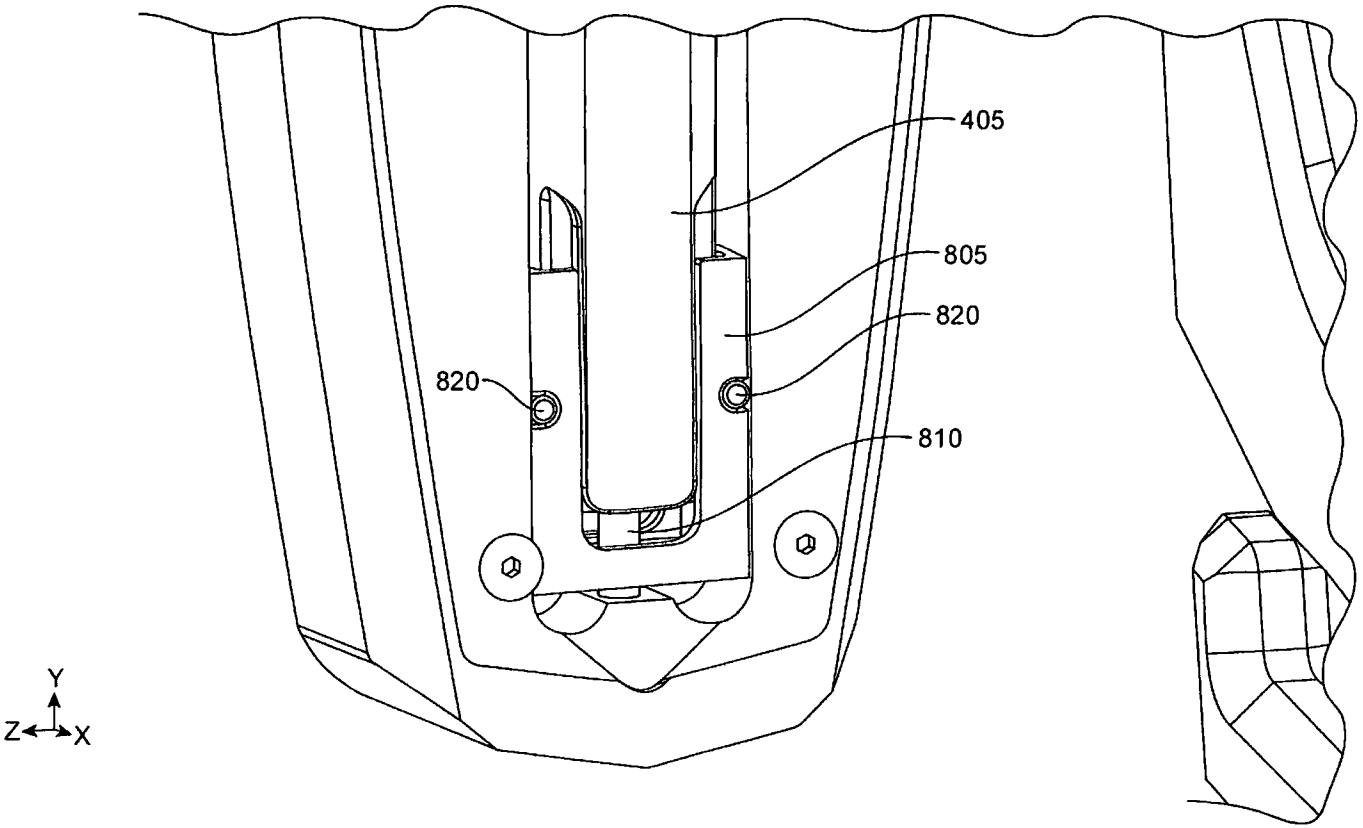

As mentioned, the central post 102 includes an internal lock mechanism. An example lock mechanism is now described in more detail. With reference again to FIG. 3, the central post includes a cover 126 that covers an internal region where the lock mechanism resides. FIG. 7 shows the central post 102 with the cover 126 removed such that the clamp arm 405 is visible. The clamp arm extends from the upper clamp member 110 to a bottom region, which is shown in an enlarged view in FIG. 8. A foot 805 is located at the bottom of the clamp arm 405, as shown in FIG. 8. An elongated rod 810 extends longitudinally through the clamp arm 405 and is attached at a bottom end to the foot 805. The foot defines a pair of openings in which are seated a corresponding pair of pins 820.

Figure 9:
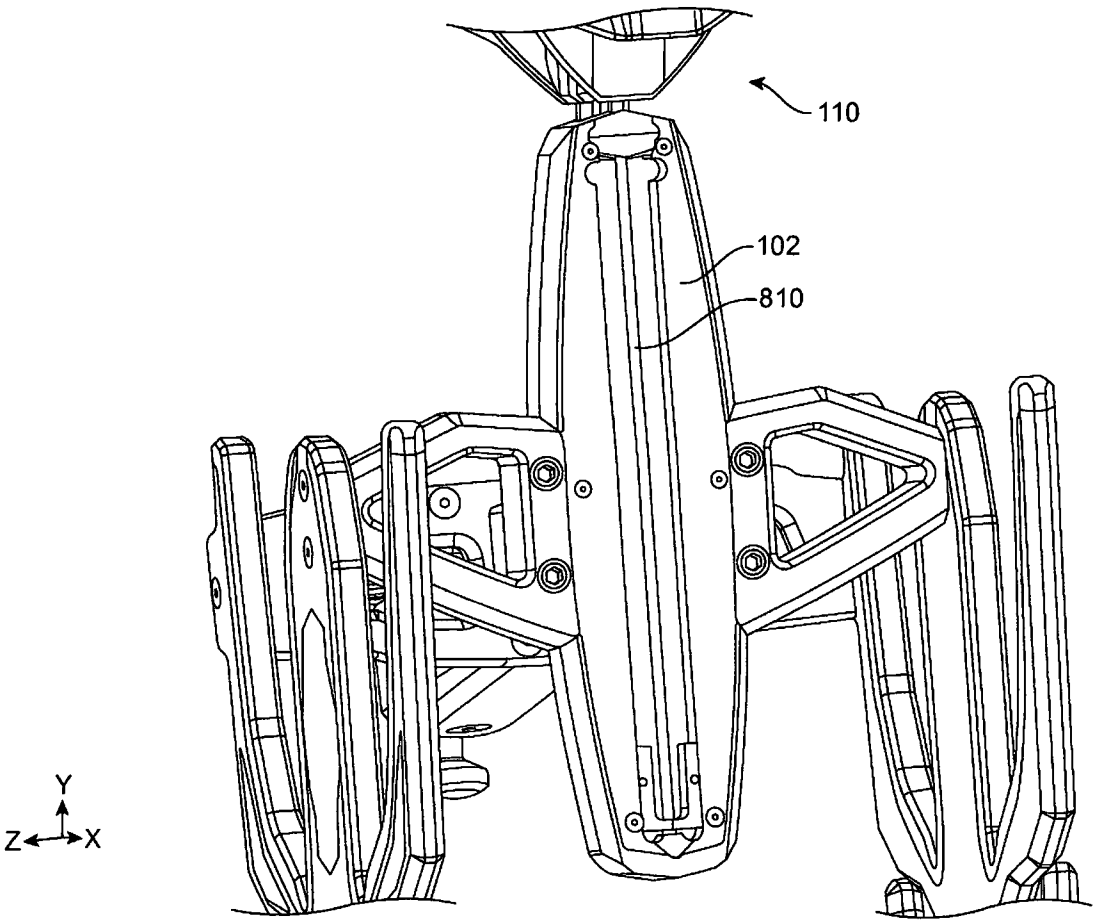
Figure 10:
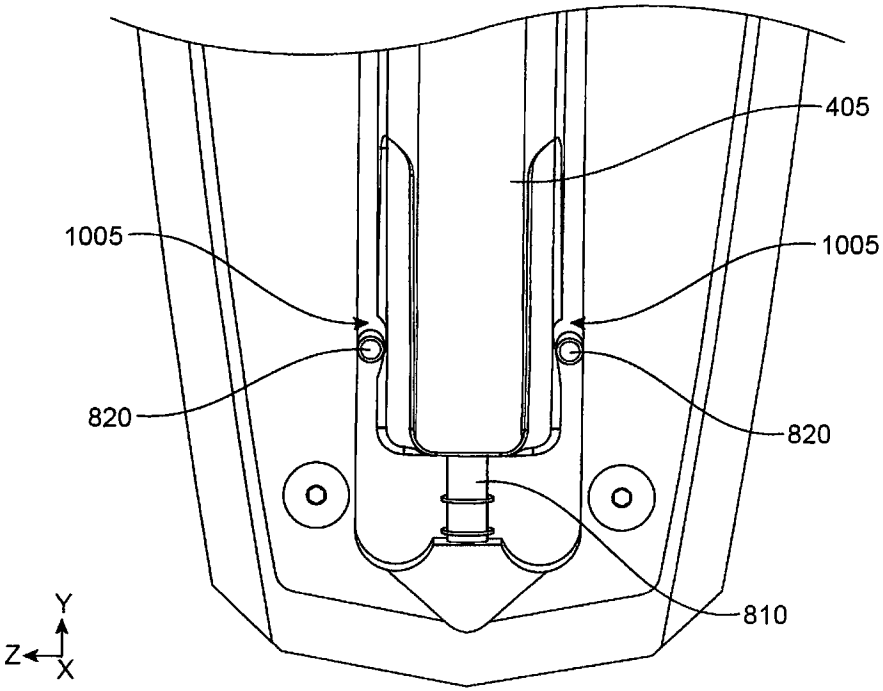

FIG. 9 shows the central post 102 with the clamp arm 405 removed such that the elongated rod 810 is visible. The rod is attached at its top end to the actuator 505, as described further below, and is slidably positioned within the central post 102. FIG. 10 shows the bottom region of FIG. 8 with the foot 805 removed and the pins 820 still in place. A bottom region of the clamp arm 405 has a pair side edges that each define ramped surfaces that form clearance areas 1005 that are wider in diameter than the pins 820. The ramped surfaces gradually increase the width of the clamp arm 405 such that the pins 820 can become locked between the ramped surfaces and an outer wall in which the clamp arm is positioned. When locked as such, the pins 820 retain the clamp arm 405 in place relative to the central post 102.

Figure 11:
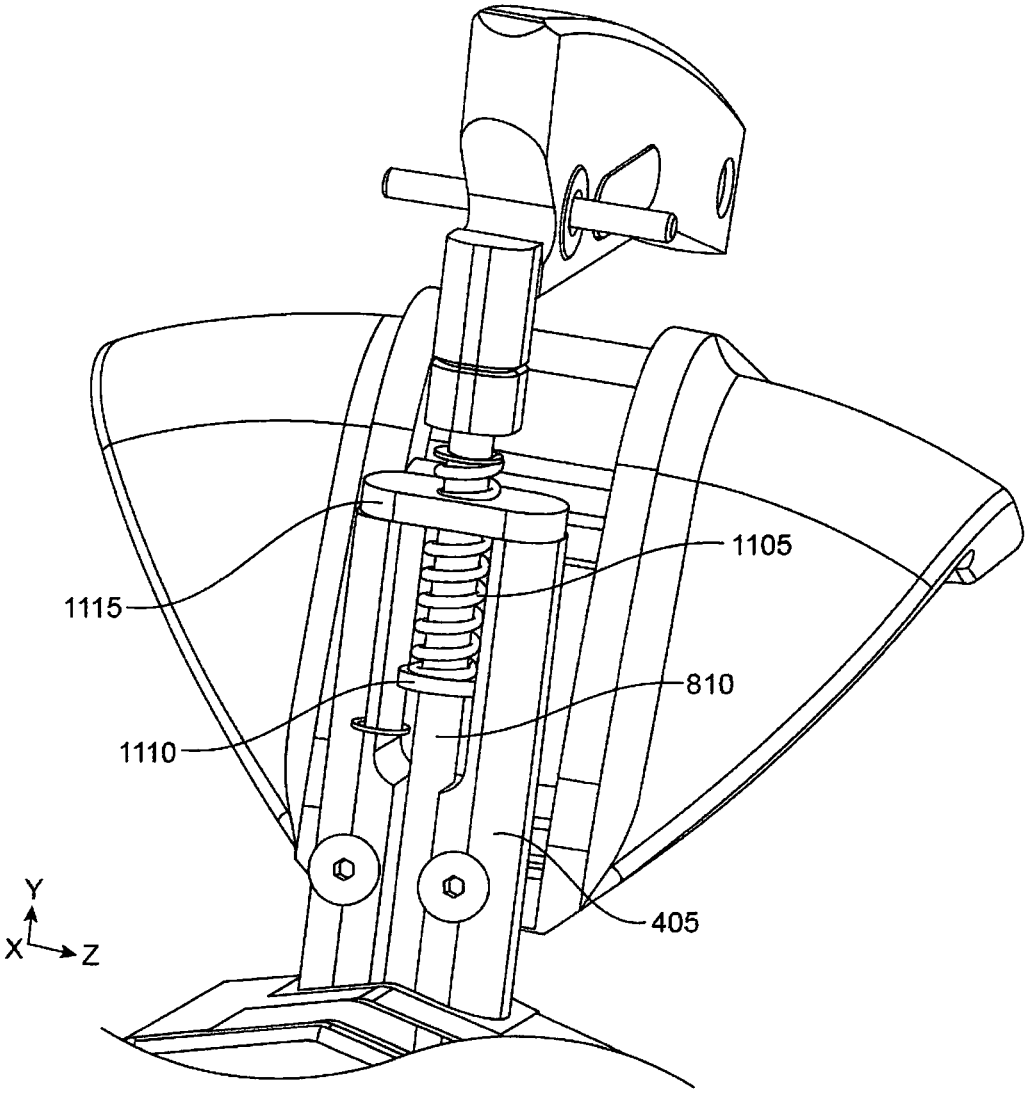

FIG. 11 shows an upper region of the clamp arm 405 with an outer cover of the upper clamp member 110 removed to show a rod assembly that includes the rod 810. A bias member, such as a spring 1105, is co-axially positioned over the rod 810 between a lower washer 1110 and an upper washer 1115 such that the spring 1105 is compressed therebetween. The lower washer 1110 is attached to the rod 810 such that it moves with the rod 810. The upper washer is fixed or stationary such that it does not move with the rod 810. The spring 1105 provides a spring force that biases the rod assembly downward.

With reference again to FIG. 10, the locking ramped surfaces allow for locking or releasing the pins 820. When at rest, the spring force of the spring 1105 pushes the rod 810 and the attached foot 805 (FIG. 8) downward, which moves the locking pins 820 against the ramped surfaces to create a locking pressure against the locking pins 820 and thereby retain the clamp arm 405 in place within the central post 102.

Figure 12:
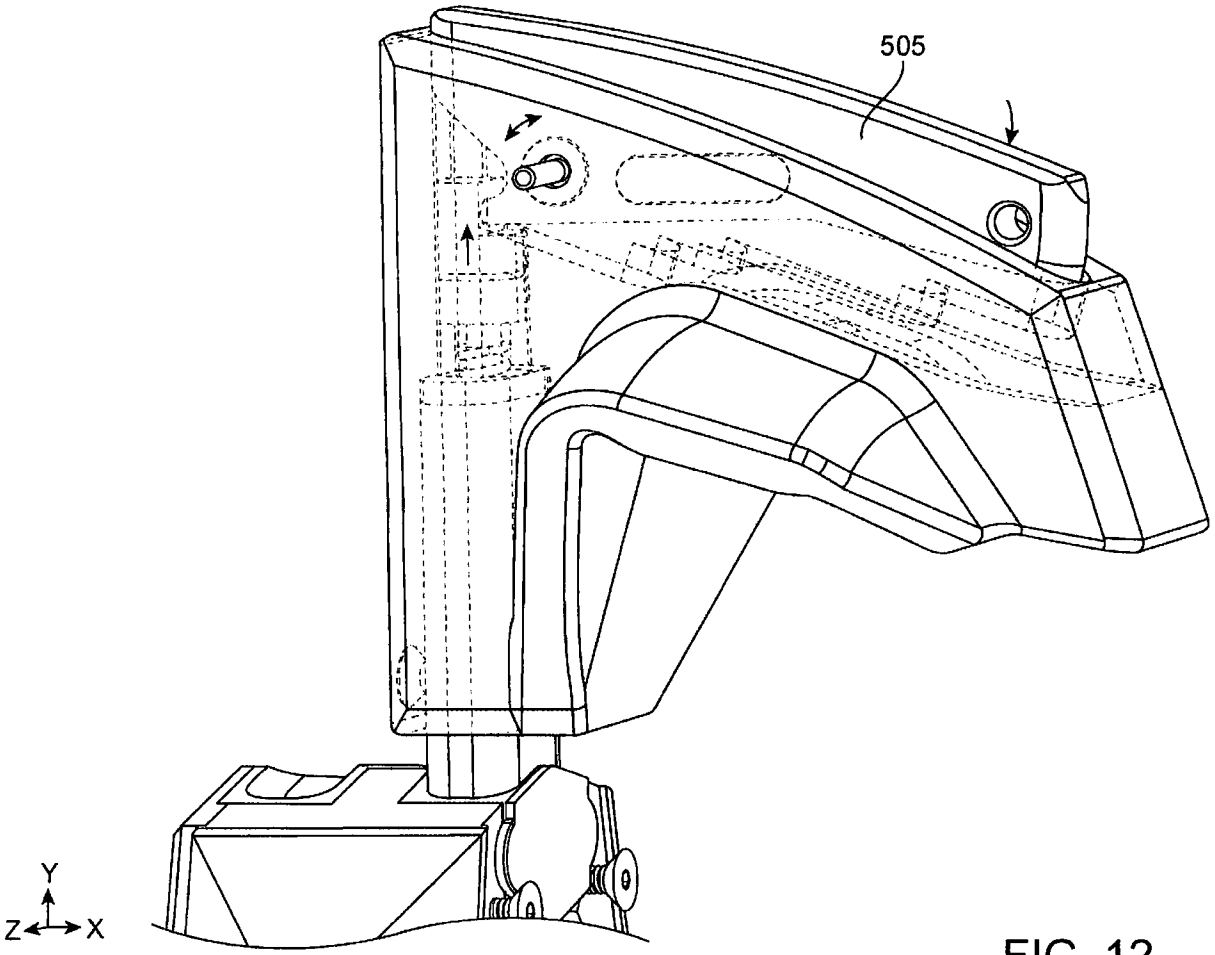

When the upper actuator 505 is pressed as shown in FIG. 12, the rod and the foot 805 move upward, which moves the locking pins 820 to the clearance area 1005 (FIG. 10) and thereby releases the locking pins from the locked state to permit the clamp arm 405 to move upward and release the clamped boards.

FIG. 12 shows the upper region of the clamp arm 405 with an outer cover of the upper clamp member 110 in transparent state to show another view of the rod assembly. In use, a user presses down on the actuator 505, which is in the form of a lever.

As mentioned, the device 100 can be attached to a boat or other vehicle. In an embodiment, the device 100 is removably attached to the boat or the vehicle such as using a clamp or other removable attachment device.

Figure 13:
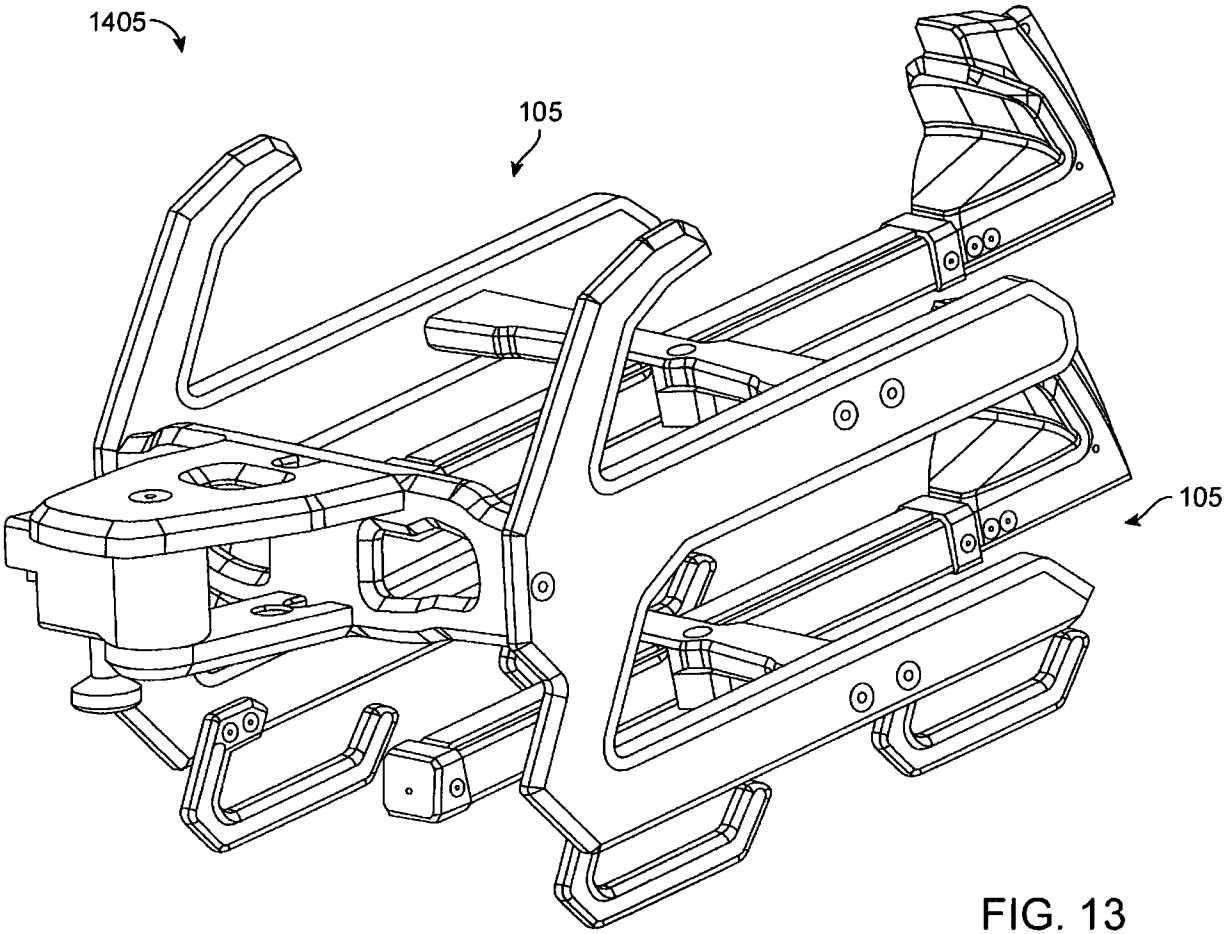
FIG. 13 shows another embodiment of a board storage device.

FIG. 13 shows another embodiment of a board storage device 1405. The board storage device 1405 includes a pair of rack assemblies 105. In this embodiment, the board storage device 1405 is configured to support the boards in a horizontal orientation rather than in a vertical orientation as in the previous embodiment. The board storage device 1405 supports the flat surfaces of the boards such that the boards are facing in a common direction. This is in contrast with the previous embodiment where the board storage device supports the flat surfaces of the boards in opposite directions. In this regard, each rack assembly 105 of the board storage device 1405 includes a base member that supports a bottom surface of the board.

Figure 14:
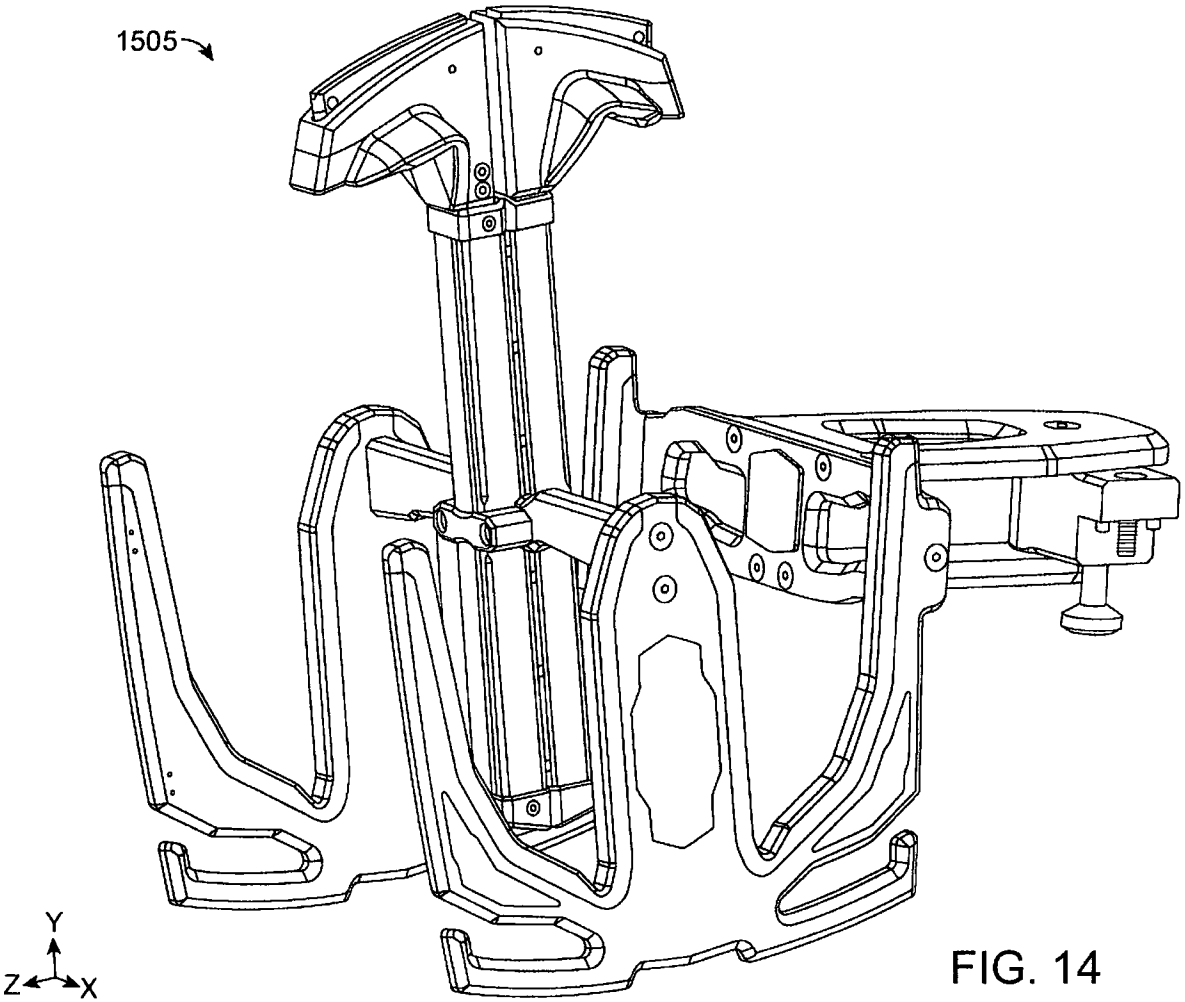
FIG. 14 shows yet another embodiment of the board storage device.

FIG. 14 shows yet another embodiment of the board storage device 1505 that supports the boards in a vertical orientation as in the first embodiment. In this embodiment, the centerpiece of the board storage device 1505 can be manufactured by an extrusion process or as a unibody construction.

Figure 17:
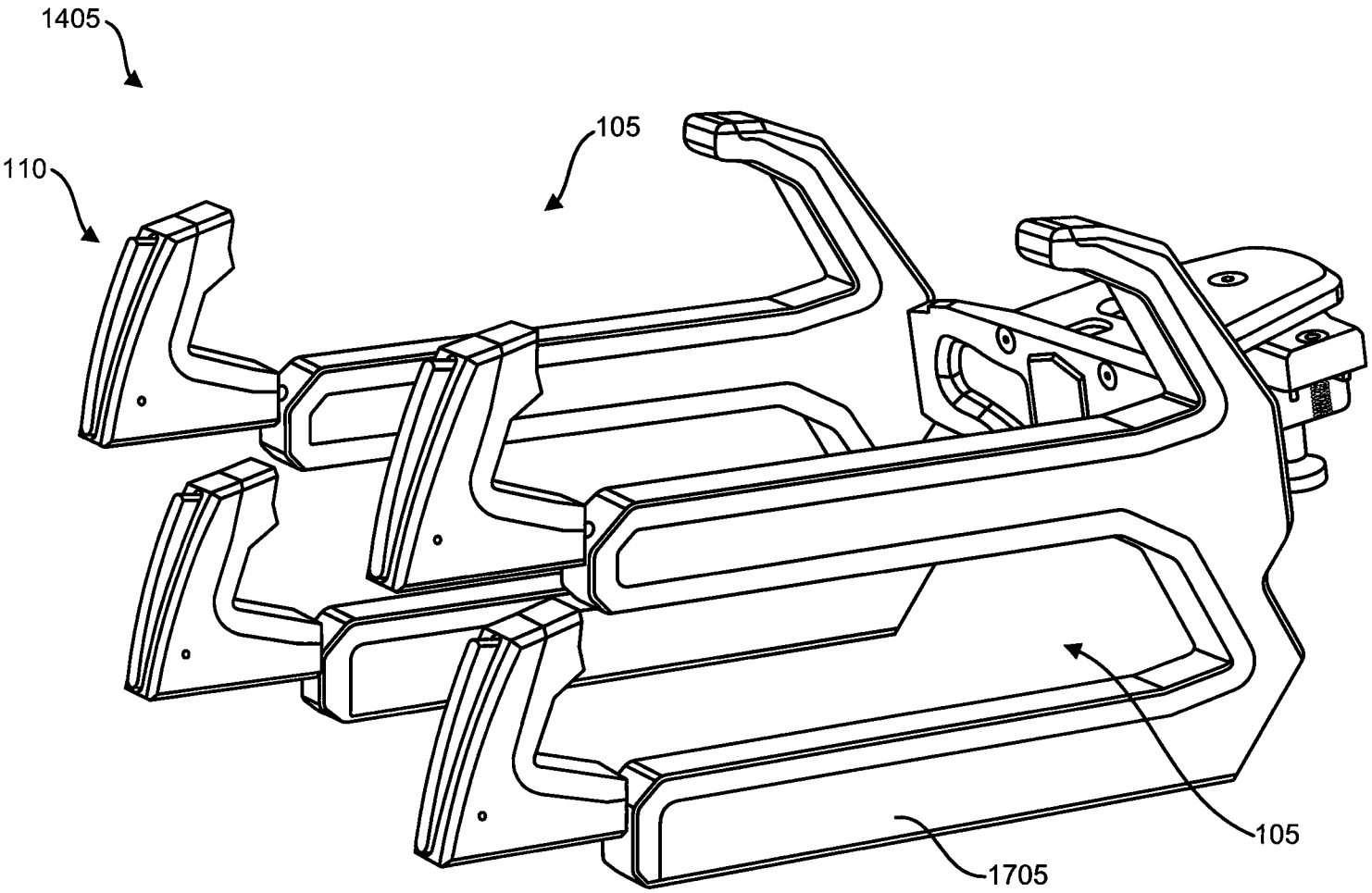
FIGS. 17 through 19 show alternate embodiments.

FIG. 17 shows another embodiment of a board storage device 1405. The board storage device 1405 includes a pair of rack assemblies 105. In this embodiment, the board storage device 1405 is configured to support the boards in a horizontal orientation rather than in a vertical orientation as in the previous embodiment. In a horizontal orientation, a top or bottom planar (or curved planar) surface of a board is positioned parallel or substantially parallel to a horizontal plane. In this regard, each rack assembly 105 of the board storage device 1405 includes a base member 1705 that supports a bottom surface of the board. Each respective base member 1705 has an upper surface or upper portion sized and shaped to support the bottom or top surface planar surface of a board such that a gravitational vector, for example, points toward the upper surface or upper portion of the respective base member 1705 on which the board is positioned.

Figure 18:
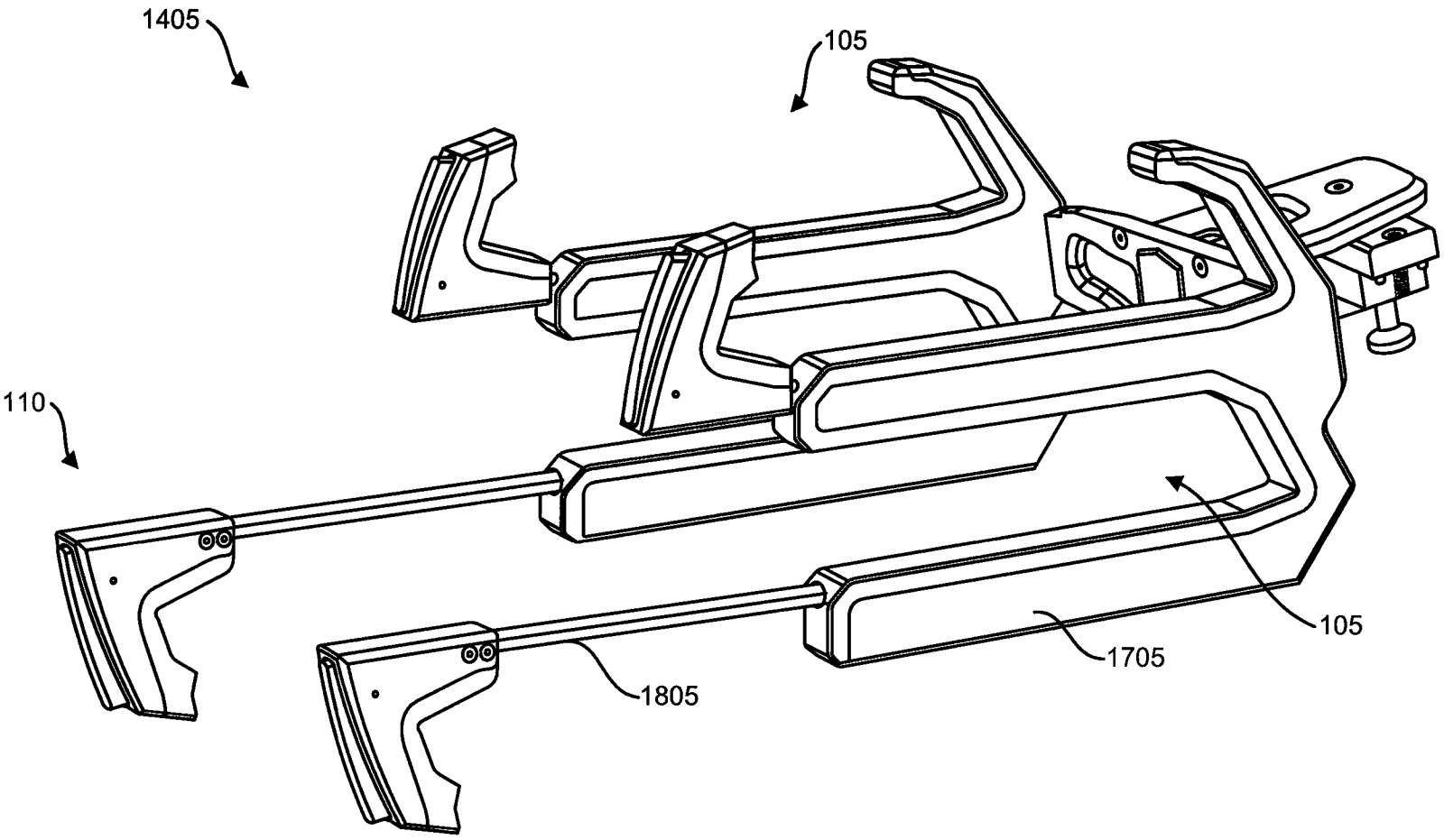
Figure 19:
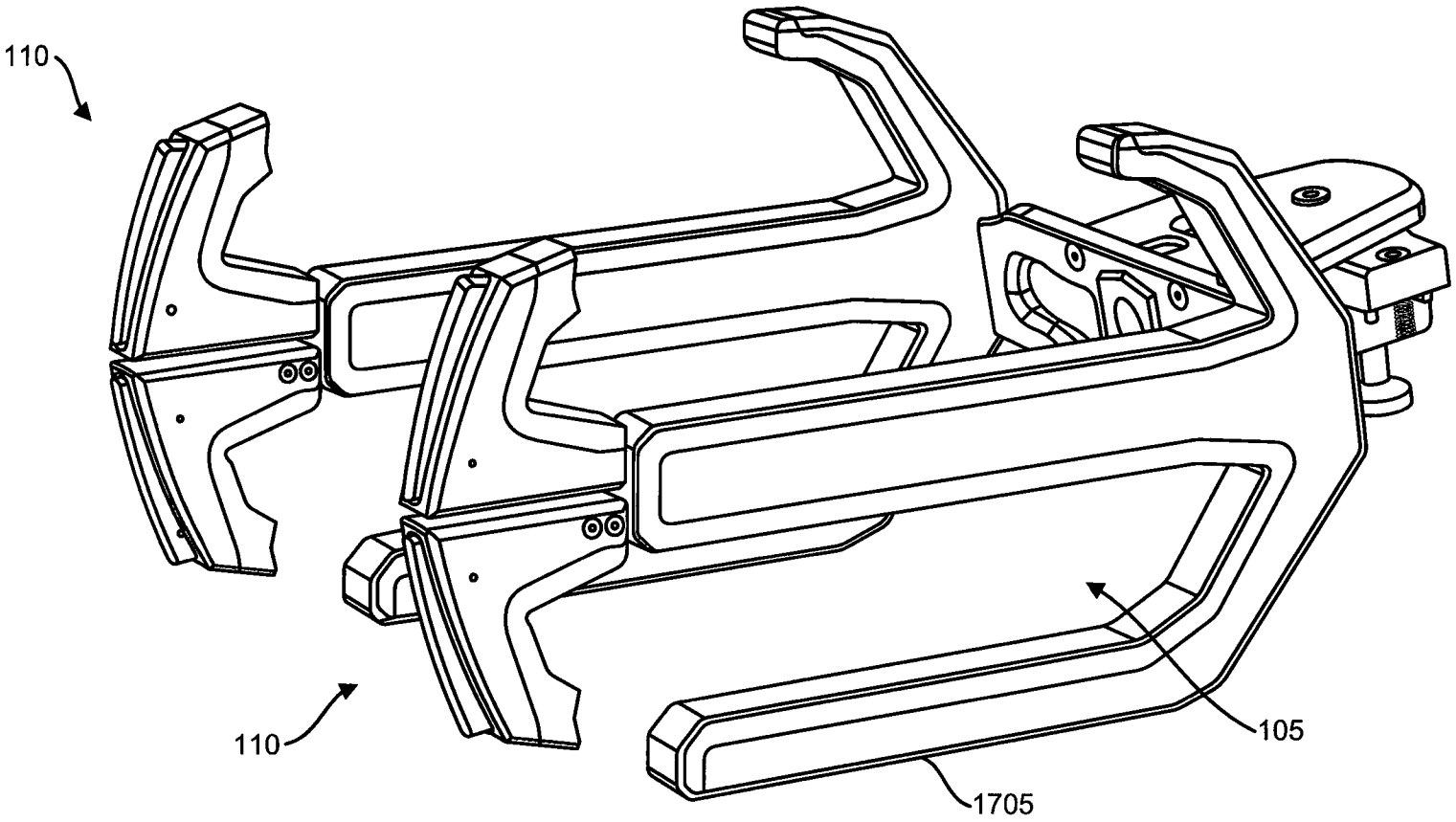

Each rack assembly has one or more respective clamp members 110 that can slidably transition between a closed state (FIG. 17) and an open state (FIG. 18.) The base member(s) 1705 are configured to provide a horizontal surface or support structure that supports a board in a horizontal orientation. In addition, the clamp members 110 can rotate about an axis defined by a rod 1805 to which they are attached. FIG. 19 shows yet another embodiment wherein the rack assembly is configured to be coupled to more than one board. The rack assembly includes at least one central post that also supports a board as well as a bottom base member 1705 that also supports a board. There is a corresponding clamp member 1705 associated with each central post and each bottom base member 1705.

As will be apparent to those of skill in the art upon reading this disclosure, each of the individual embodiments described and illustrated herein has discrete components and features which may be readily separated from or combined with the features of any of the other several embodiments without departing from the scope of the subject matter described herein. Any recited method can be carried out in the order of events recited or in any other order which is logically possible.

While this specification contains many specifics, these should not be construed as limitations on the scope of an invention that is claimed or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or a variation of a sub-combination. Similarly, while operations are depicted in the drawings in a particular order, this should not be understood as requiring that such operations be performed in the particular order shown or in sequential order, or that all illustrated operations be performed, to achieve desirable results.

The invention claimed is:

1. A wakeboard storage apparatus, comprising:

a first base member formed of a first elongated arm that supports a surface of a first wakeboard;

a first elongated biasing member extending through the first base member;

a second base member formed of a second elongated arm that supports the surface of the first wakeboard;

a second elongated biasing member extending through the second base member;

a first clamp member mechanically coupled to the first base member and attached to the first elongated biasing member, the first clamp member slideably movable relative to the first base member along a first axis defined by the first base member, the first clamp member being slideably movable between a clamped position and an unclamped position, wherein the first clamp member engages a first portion of the first wakeboard when the first wakeboard is stored in the wakeboard storage apparatus;

a second clamp member mechanically coupled to the second base member and attached to the second elongated biasing member, the second clamp member slideably movable relative to the second base member along a second axis defined by the second base member, the second axis different from the first axis, the second clamp member being slideably movable between a clamped position and an unclamped position, wherein the second clamp member engages a second portion of the first wakeboard when the first wakeboard is stored in the wakeboard storage apparatus;

a third base member formed of a third elongated arm that supports a surface of a second wakeboard when the second wakeboard is stored in the wakeboard storage apparatus;

a third elongated biasing member extending through the third base member;

a fourth base member formed of a fourth elongated arm that supports the surface of the second wakeboard when the second wakeboard is stored in the wakeboard storage apparatus;

a fourth elongated biasing member extending through the fourth base member;

a third clamp member mechanically coupled to the third base member and attached to the third elongated biasing member, the third clamp member slideably movable relative to the third base member along a third axis defined by the third base member, the third clamp member being slideably movable between a clamped position and an unclamped position, wherein the third clamp member engages a first portion of the second wakeboard when the second wakeboard is stored in the wakeboard storage apparatus;

a fourth clamp member mechanically coupled to the fourth base member and attached to the fourth elongated biasing member, the fourth clamp member slideably movable relative to the fourth base member along a fourth axis defined by the fourth base member, the fourth clamp member being slideably movable between a clamped position and an unclamped position, wherein the fourth clamp member engages a second portion of the second wakeboard when the second wakeboard is stored in the wakeboard storage apparatus; and wherein the third clamp member and the fourth clamp member are configured to restrain the second wakeboard to the wakeboard storage apparatus when the second wakeboard is stored in the wakeboard storage apparatus;

a cross member that connects to the first base member and the second base member such that the first base member and the second base member cantilever from the cross member, wherein the entire cross member is positioned between the first base member and the second base member:

wherein the first, second, third and fourth elongated arms are substantially the same length and are spaced apart from one another, and wherein, when the first wakeboard and the second wakeboard are mounted on the wakeboard storage apparatus, (1) the first and second base members are positioned between the first wakeboard and the second wakeboard and (2) the third base member and the fourth base member are positioned on the opposite side of the second wakeboard from the first and second base members.

2. The wakeboard storage apparatus of claim 1, wherein each of the first clamp member and the second clamp member defines a hook shape.

3. The wakeboard storage apparatus of claim 1, further comprising a hook that can support a life jacket.

4. The wakeboard storage apparatus of claim 1, further comprising the first wakeboard.

5. The wakeboard storage apparatus of claim 1, wherein the wakeboard storage apparatus is coupled to an attachment mechanism configured to attach the body to a boat.

6. A wakeboard storage apparatus, comprising:

a first base member formed of a first elongated arm that supports a surface of a first wakeboard;

a first spring extending through the first base member;

a second base member formed of a second elongated arm that supports the surface of the first wakeboard;

a second spring extending through the second base member;

a first clamp member mechanically coupled to the first base member and attached to the first elongated biasing member, the first clamp member slideably movable relative to the first base member along a first axis defined by the first base member, the first clamp member being slideably movable between a clamped position and an unclamped position;

a second clamp member mechanically coupled to the second base member and attached to the second elongated biasing member, the second clamp member slideably movable relative to the second base member along a second axis defined by the second base member, the second clamp member being slideably movable between a clamped position and an unclamped position;

a third base member formed of a third elongated arm that supports a surface of a second wakeboard when the second wakeboard is stored in the wakeboard storage apparatus;

a third spring extending through the third base member;

a fourth base member formed of a fourth elongated arm that supports the surface of the second wakeboard when the second wakeboard is stored in the wakeboard storage apparatus;

a fourth spring extending through the fourth base member;

a third clamp member mechanically coupled to the third base member and attached to the third elongated biasing member, the third clamp member slideably movable relative to the third base member along a third axis defined by the third base member, the third clamp member being slideably movable between a clamped position and an unclamped position;

a fourth clamp member mechanically coupled to the fourth base member and attached to the fourth elongated biasing member, the fourth clamp member slideably movable relative to the fourth base member along a fourth axis defined by the fourth base member, the fourth clamp member being slideably movable between a clamped position and an unclamped position; and a cross member that connects to the first base member and the second base member, wherein the entire cross member is positioned between the first base member and the second base member;

wherein, when the first wakeboard and the second wakeboard are mounted on the wakeboard storage apparatus, (1) the first and second base members are positioned between the first wakeboard and the second wakeboard and (2) the third base member and the fourth base member are positioned on the opposite side of the second wakeboard from the first and second base members.

7. The wakeboard storage apparatus of claim 1, wherein the entire cross member is positioned between a proximal end of the first base member and a proximal end of the second base member and wherein a first end of the cross member is connected to the proximal end of the first base member and a second end of the cross member is connected to the proximal end of the second base member.

* * * * *